US007106269B1

(12) United States Patent
Tonn

(10) Patent No.: US 7,106,269 B1
(45) Date of Patent: Sep. 12, 2006

(54) OMNI-AZIMUTHAL PATTERN GENERATOR FOR VLF AND LF COMMUNICATION

(75) Inventor: David A. Tonn, Charlestown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 79 days.

(21) Appl. No.: 11/076,107

(22) Filed: Feb. 18, 2005

(51) Int. Cl.
*H01Q 9/16* (2006.01)

(52) U.S. Cl. ..... 343/820; 342/361

(58) Field of Classification Search ..... 343/793, 343/820; 342/361, 373
See application file for complete search history.

(56) References Cited

U.S. PATENT DOCUMENTS 4,209,791 A 6/1980 Gerst et al.
4,697,191 A 9/1987 Cross
5,343,173 A 8/1994 Balodis et al.
5,943,012 A 8/1999 Sinclair
6,445,357 B1 * 9/2002 Sinclair ..... 343/820

* cited by examiner

*Primary Examiner*—Hoang V. Nguyen
(74) *Attorney, Agent, or Firm*—Jean-Paul A. Nasser; James M. Kasaschke; Michael P. Stanley

(57) ABSTRACT

A relative phase shift is induced in the signals of a pair of identical orthogonal antennas such that when the signals are combined the signals are 90 degrees out of phase. This is done in order to eliminate the null along the axis between the two dipole moments of the antennas such that the system has equally good reception from all azimuth angles over a broad range of frequencies. The phase shift is accomplished with the use of single pole operational amplifier circuits whose pole frequencies are adjusted by means of a potentiometer prior to implementation of the antenna system.

12 Claims, 7 Drawing Sheets

OMNI-AZIMUTHAL PATTERN GENERATOR FOR VLF AND LF COMMUNICATION

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER RELATED APPLICATIONS

Not applicable.

BACKGROUND OF THE INVENTION (1) Field of the Invention

The present invention relates to antennas, and more specifically to the elimination of the null along the axis coincident with the dipole moment of an antenna.

(2) Description of the Prior Art

Electrically small antennas possess a pattern in azimuth that has a null along an axis coincident with the dipole moment of the antenna. This null renders the antenna "blind" along that axis. If two antennas are used and the signals are combined, a null occurs along an axis between the two dipole moments. An ideal antenna system would be one capable of rendering equally good reception from all azimuth angles without a null in the antenna pattern(s).

It is possible to remove the null in the azimuthal response of a pair of identical orthogonal antennas by combining the two signals together ninety degrees out of phase. Adding the two signals in phase only causes the null in the azimuth pattern to shift to a position midway between the dipole moments of the two antennas.

In the past, it has been quite easy to introduce a 90-degree phase shift, at only a single frequency, by the use of a simple, single-pole electrical network. The disadvantage is that over a broad range of frequencies the user has to retune the circuit every time the frequency of operation changes. The challenge is to accomplish a ninety degree phase shift between two identical orthogonal antenna signals and be able to do so over a broad range of frequencies for example from 10 kHz to 200 kHz without exceeding a 3 dB pattern deformation.

SUMMARY OF THE INVENTION

It is a general purpose and object of the present invention to generate an antenna pattern that does not change as a function of azimuth angle, but has equally good reception from all azimuth angles.

It is an additional purpose to generate such an omniazimuthal antenna pattern over a broad range of frequencies in a manner that does not require manual retuning or adjustment.

These objects are accomplished through the introduction of a "relative" phase shift in a pair of identical orthogonally mounted loop antennas whereby operational-amplifier circuits in a network within the antenna system are all single pole circuits, with the pole frequency of the single pole circuits being adjustable by means of a potentiometer.

DESCRIPTION OF THE PREFERRED EMBODIMENT

Figure 1:
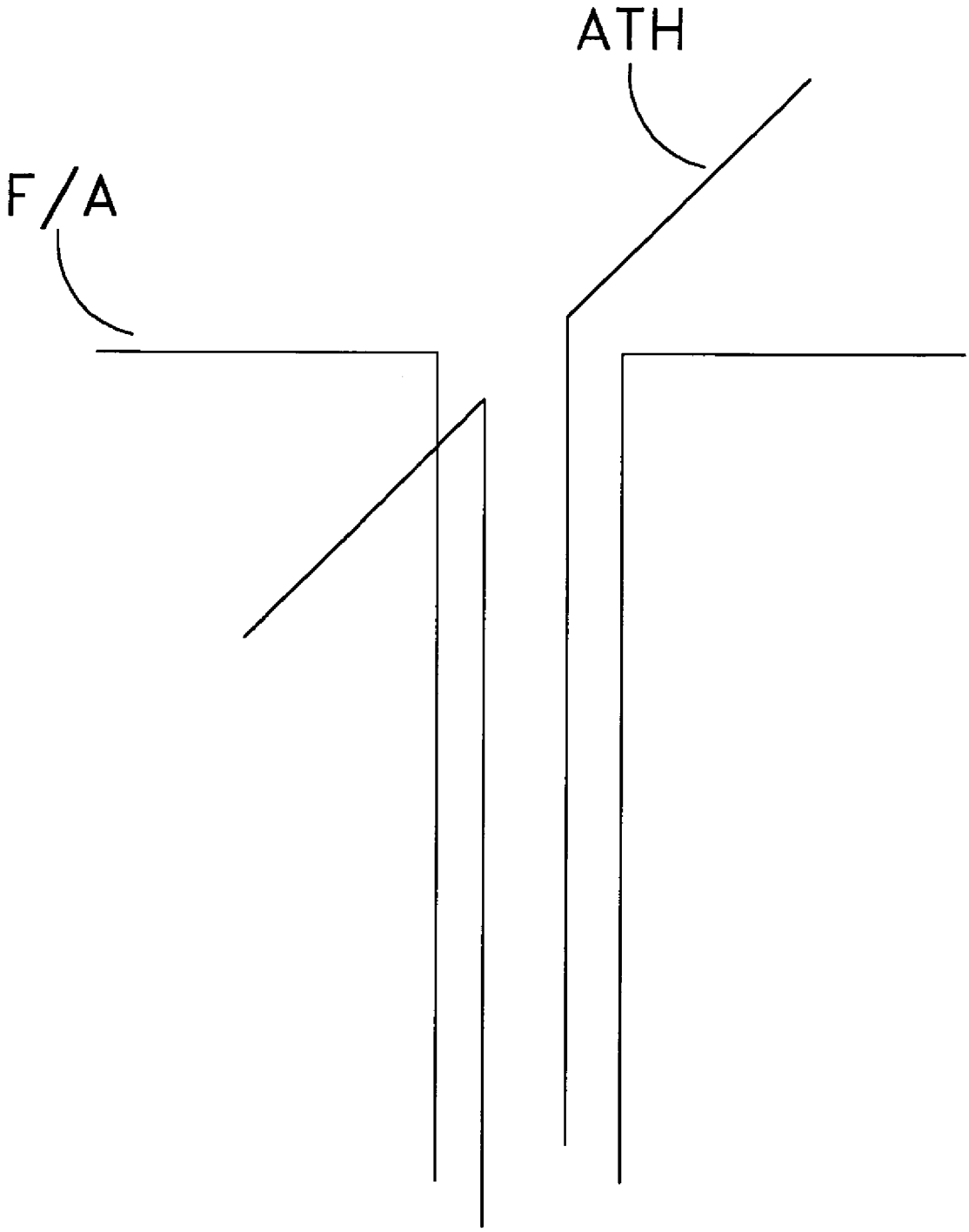
FIG. 1 is an equivalent representation of two orthogonally mounted antennas.

The omni-azimuthal pattern generator is designed to work with the AN/BRA-34 (V) and OE-538/BRC VLF/LF loop antennas. It is not, however, limited as such and can be scaled and applied to other frequency ranges of interest. Inside each of these antennas are two identical orthogonally mounted loop antennas, called the "Fore/Aft" (F/A) and "Athwart" (ATH) loops. Referring now to FIG. 1 the equivalent representation of the identical orthogonal antennas F/A and ATH is illustrated. The outputs of each of these antennas is amplified in the antenna housing and presented as a balanced twisted pair transmission line.

Figure 2:
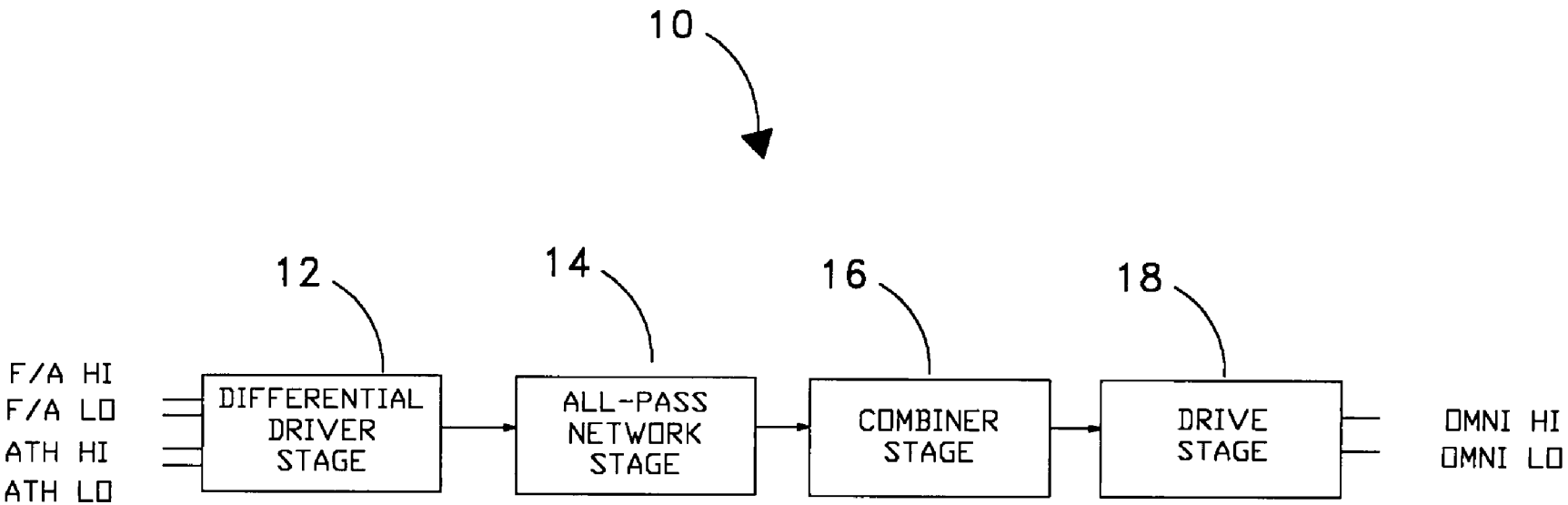
FIG. 2 is a block diagram of the circuit stages of the omni-azimuthal pattern generator.

Referring now to FIG. 2, there is illustrated a block diagram of the four stages of the omni-azimuthal pattern generator 10. The first stage is the differential driver stage 12. The two balanced twisted pair transmission lines from the orthogonal antennas F/A and ATH enter the omni-azimuthal pattern generator 10 at the differential driver stage 12 at the points denoted "F/A HI", "F/A LO", "ATH HI", "ATH LO". The next stage is the all-pass network 14, so called because it has approximately unity gain over a wide frequency range. The all-pass network introduces a relative phase shift of 90 degrees between the two antenna signals. The signals are then combined in the combiner stage 16. In the final stage, the drive stage 18, the combined signal is amplified. The resulting output of the omni-azimuthal pattern generator 10 is an "OMNI HI" signal and an "OMNI LO" signal.

Figure 3:
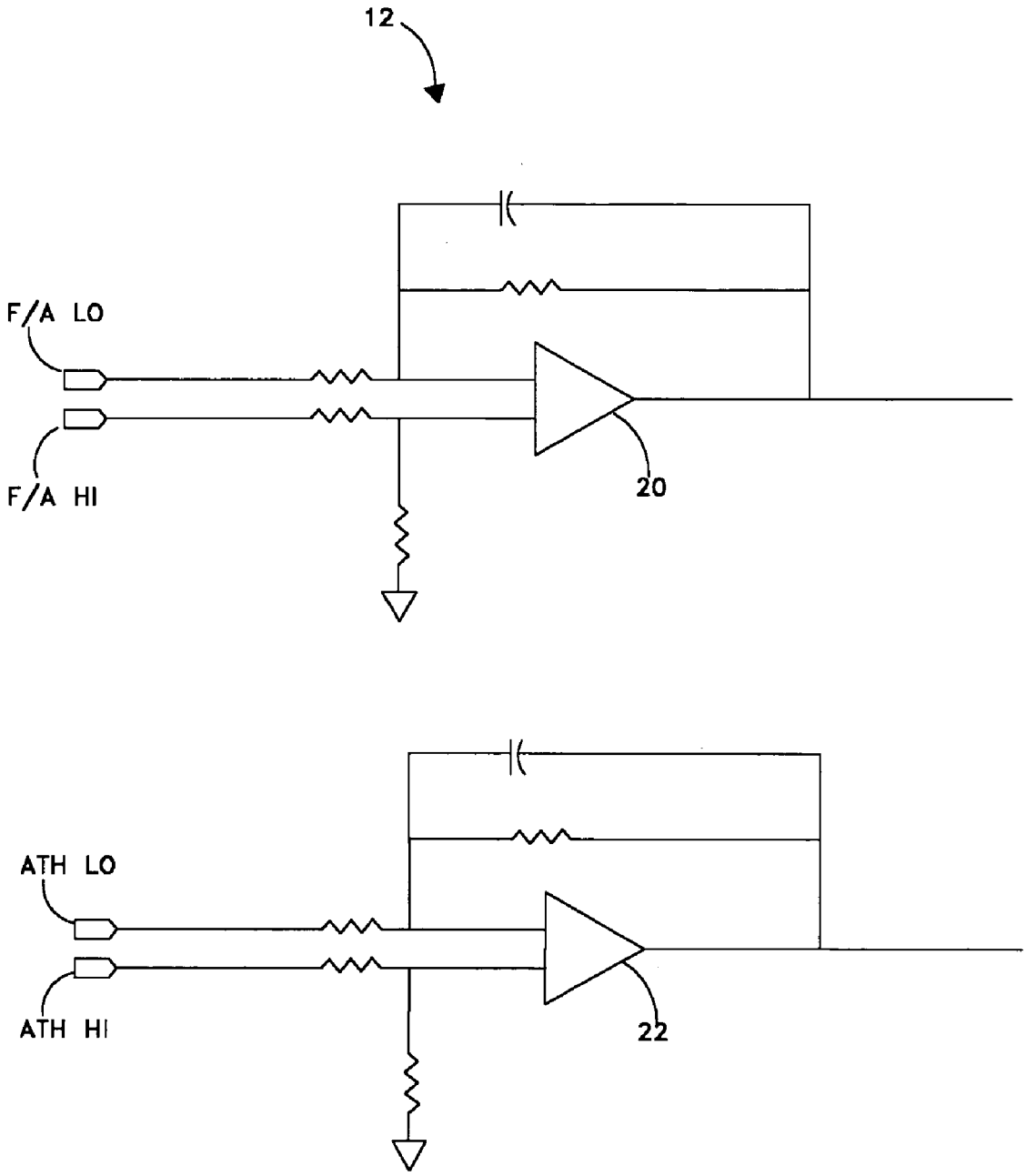
FIG. 3 is a circuit diagram of the differential driver stage of the omni-azimuthal pattern generator.

Referring now to FIG. 3, there is illustrated a circuit diagram of the differential driver stage 12. Operational amplifiers 20 and 22 and associated resistors serve as isolation amplifiers and to convert the balanced input into an unbalanced signal for subsequent conditioning.

Figure 4:
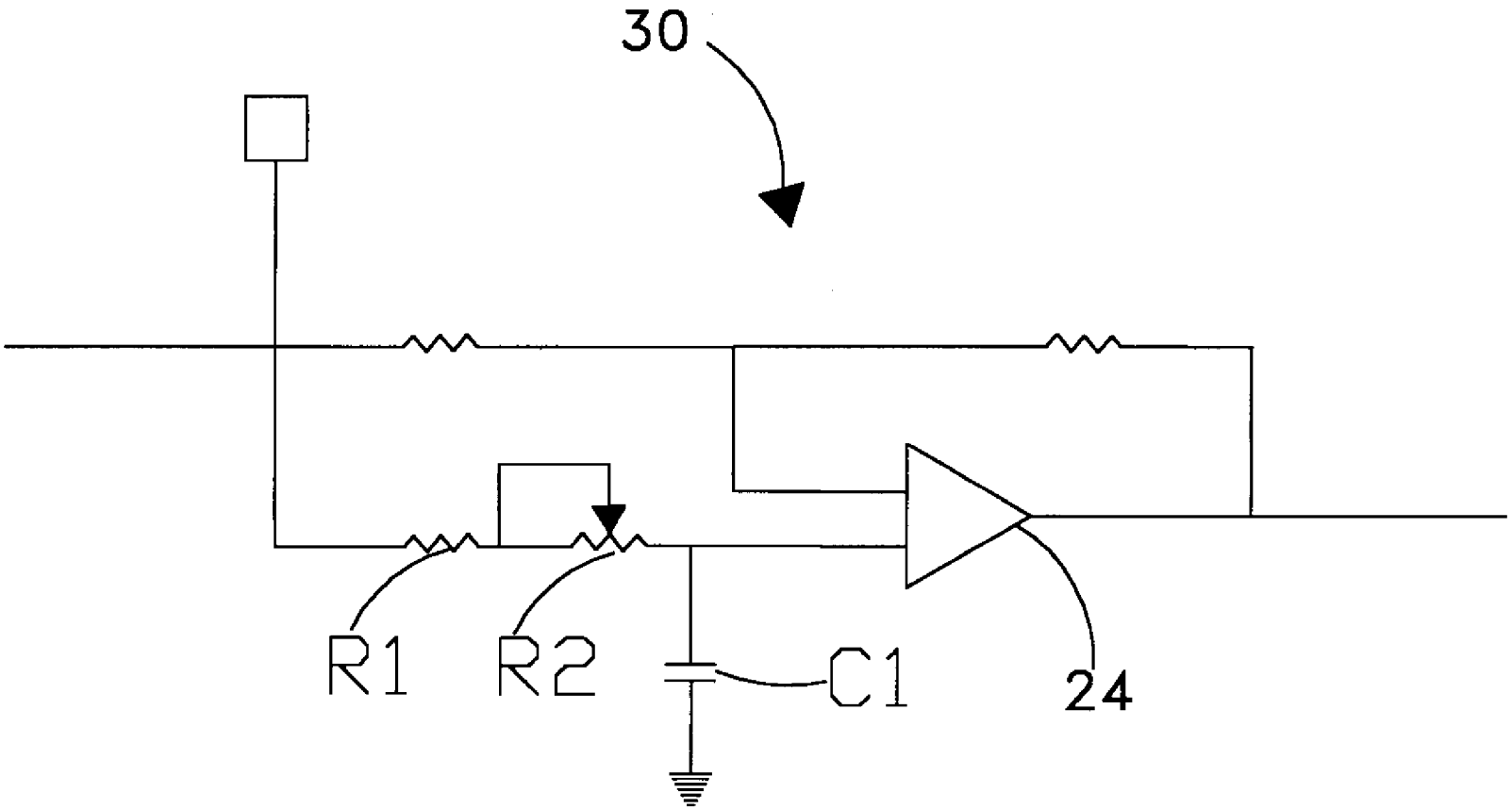
FIG. 4 is a circuit diagram of a single building block circuit of the all-pass network.
Figure 5:
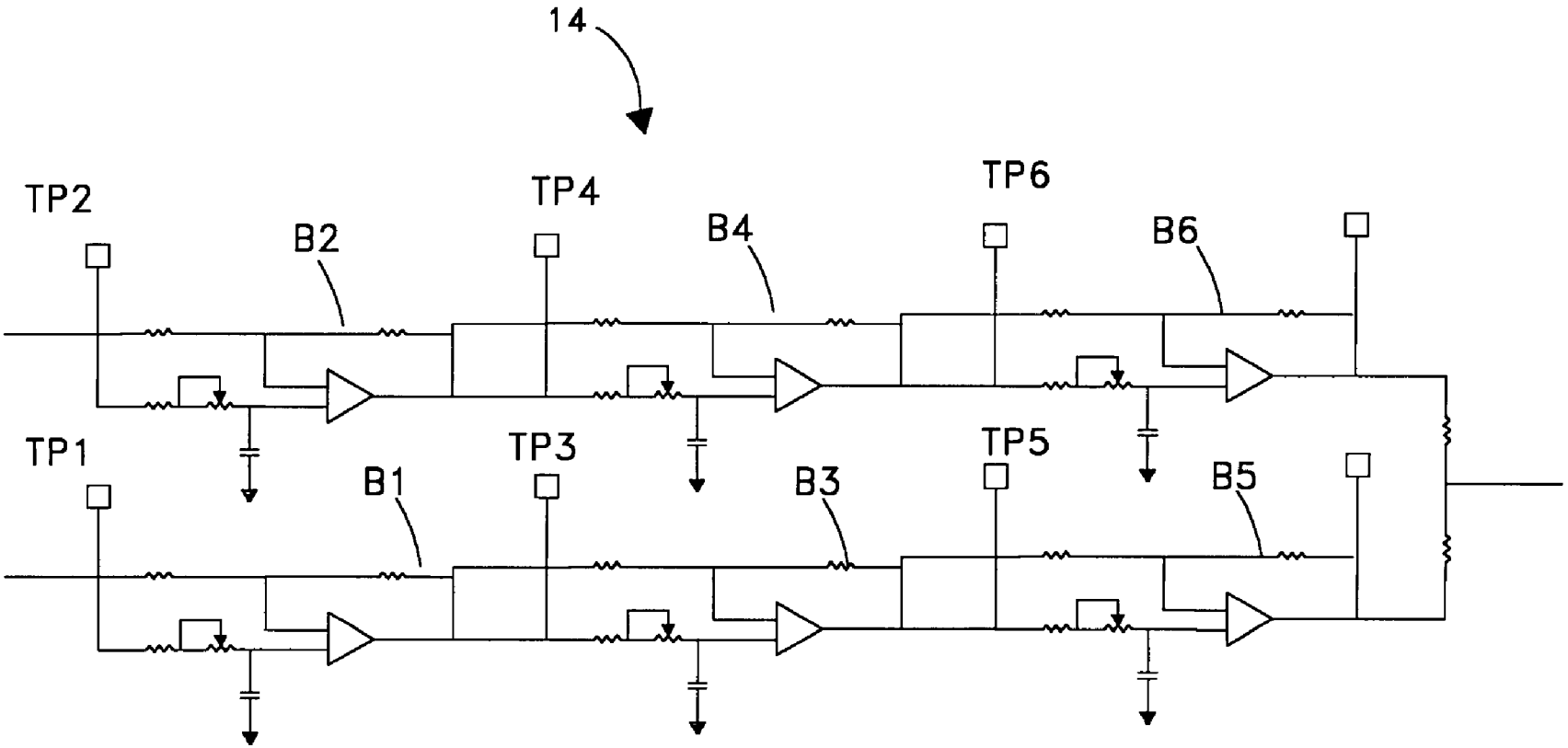
FIG. 5 is a circuit diagram of the entire all-pass network stage of the omni-azimuthal pattern generator.

Referring now to FIG. 4 and FIG. 5, there is illustrated in FIG. 4 a single building block circuit 30 of the active all-pass network 14 consisting of an operational amplifier 24 a potentiometer $R_2$, a resistor $R_1$, a capacitor $C_1$ and other circuit elements. In FIG. 5 there is illustrated the entire all-pass network 14 consisting of two parallel sets of three of the single building block circuits 30 in series labeled B1 to B6. As stated above, the active all-pass network 14 introduces a relative phase shift of 90 degrees between the F/A leg of the circuit along the top three building block circuits B2, B4, B6, and the ATH leg of the circuit along the bottom three building block circuits B1, B3, and B5. A relative rather than absolute phase shift is sufficient since the absolute phases of the signals are unimportant. The building block circuits B1 to B6 in the all-pass network 14 are all single pole circuits, with the pole frequency being adjustable by means of a potentiometer $R_2$.

The transfer function H(jω) of this network can be shown to be:

$$H(j\omega) = \frac{1 - j\omega R_{EI} C_1}{1 + j\omega R_{EI} C_1},\ R_{EI} = R_1 + R_2 \quad (1)$$

By cascading the several building block circuits 30, the phase shift from input to output of each leg of the all-pass network 14 can be derived as follows:

$$\phi(F/A) = -2 \text{ arc tan } (\omega/p2) - 2 \text{ arc tan } (\omega/p4) - 2 \text{ arc tan } (\omega/p6) \quad (2)$$

$$\phi(ATH) = -2 \text{ arc tan } (\omega/p1) - 2 \text{ arc tan } (\omega/p3) - 2 \text{ arc tan } (\omega/p5) \quad (2)$$

Here, the "pN" represent the pole frequencies of each of the six building block circuits B1 to B6 of the all-pass network. The pole frequencies in these equations are expressed as angular frequencies. When the two signals are subtracted the resulting phase difference between the F/A and ATH legs of the all-pass network 14 will be:

$$\Delta\phi = 2[\text{arc tan}(\omega/p1) + \text{arc tan}(\omega/p2) - \text{arc tan}(\omega/p3) + \text{arc tan}(\omega/p4) - \text{arc tan}(\omega/p5) + \text{arc tan}(\omega/p6)] \quad (4)$$

By proper selection of the pole frequencies of each of the building block circuits B1 to B6, it is possible to tailor this response to provide a value of Δϕ that is close to 90 degrees over the frequency band of interest.

The required pole frequencies that drive the all-pass network 14 are shown in Table 1 below:

| Building Block Circuit # | p/2π (Hz) |
|---|---|
| 1 | 1687 |
| 2 | 7335 |
| 3 | 22,915 |
| 4 | 69,824 |
| 5 | 218,143 |
| 6 | 948,000 |

Potentiometers $R_2$ are utilized in B1 through B6 to calibrate the all-pass network 14 before it is used. This is critical to ensure that the pole frequencies are correctly set so that proper operation of the circuit over the VLF/LF band is maintained. The test points TP1 to TP6 in FIG. 5 allow a dual channel digitizing oscilloscope (not shown) to be connected in order to set the pole frequencies precisely by means of the potentiometers $R_2$ in B1 to B6.

Figure 6:
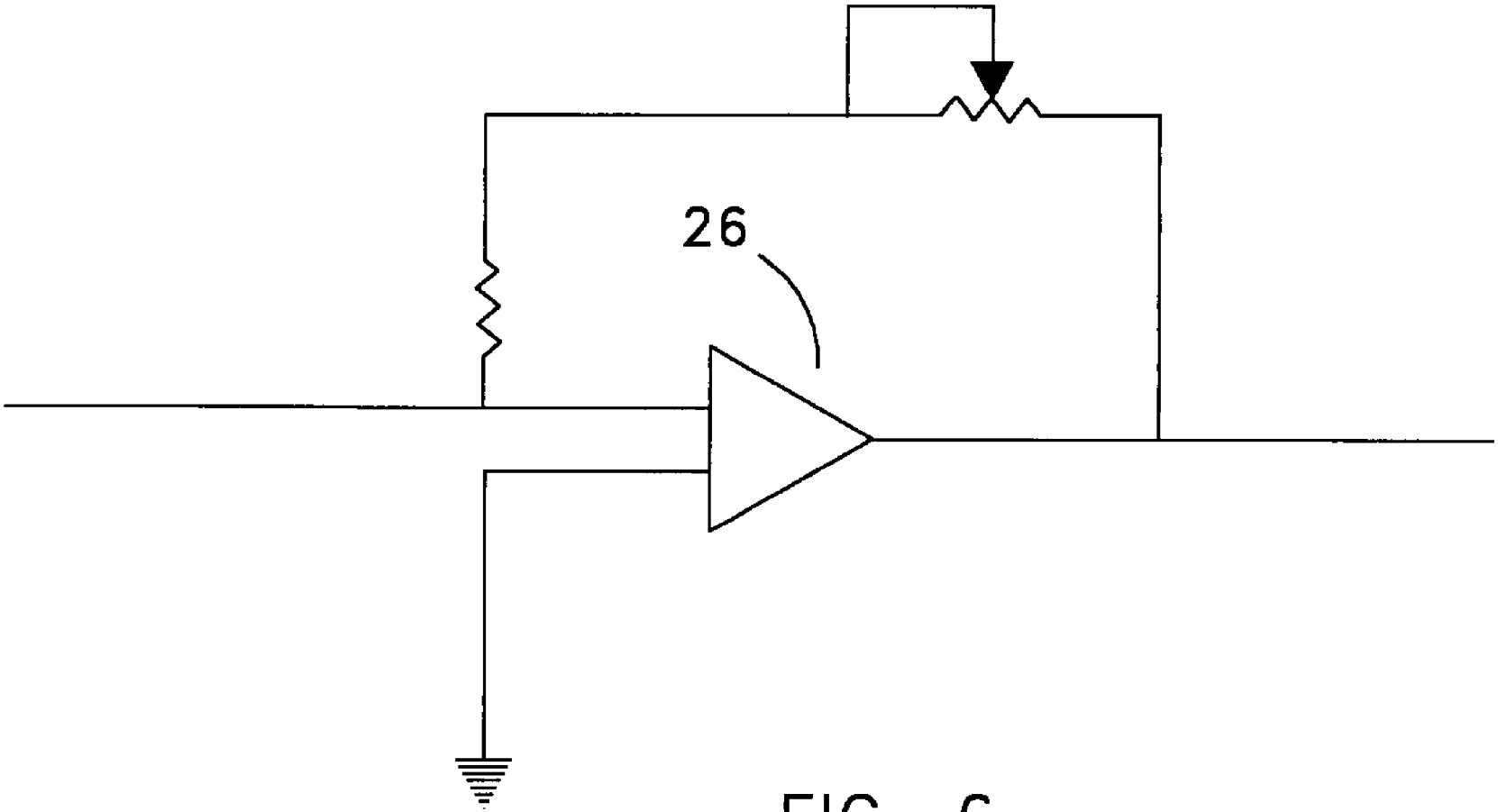
FIG. 6 is a circuit diagram of the combiner stage of the omni-azimuthal pattern generator.

Referring to FIG. 6 there is illustrated the circuit diagram for the combiner stage 16. The operational amplifier 26 combines the outputs from the all-pass network 14.

Figure 7:
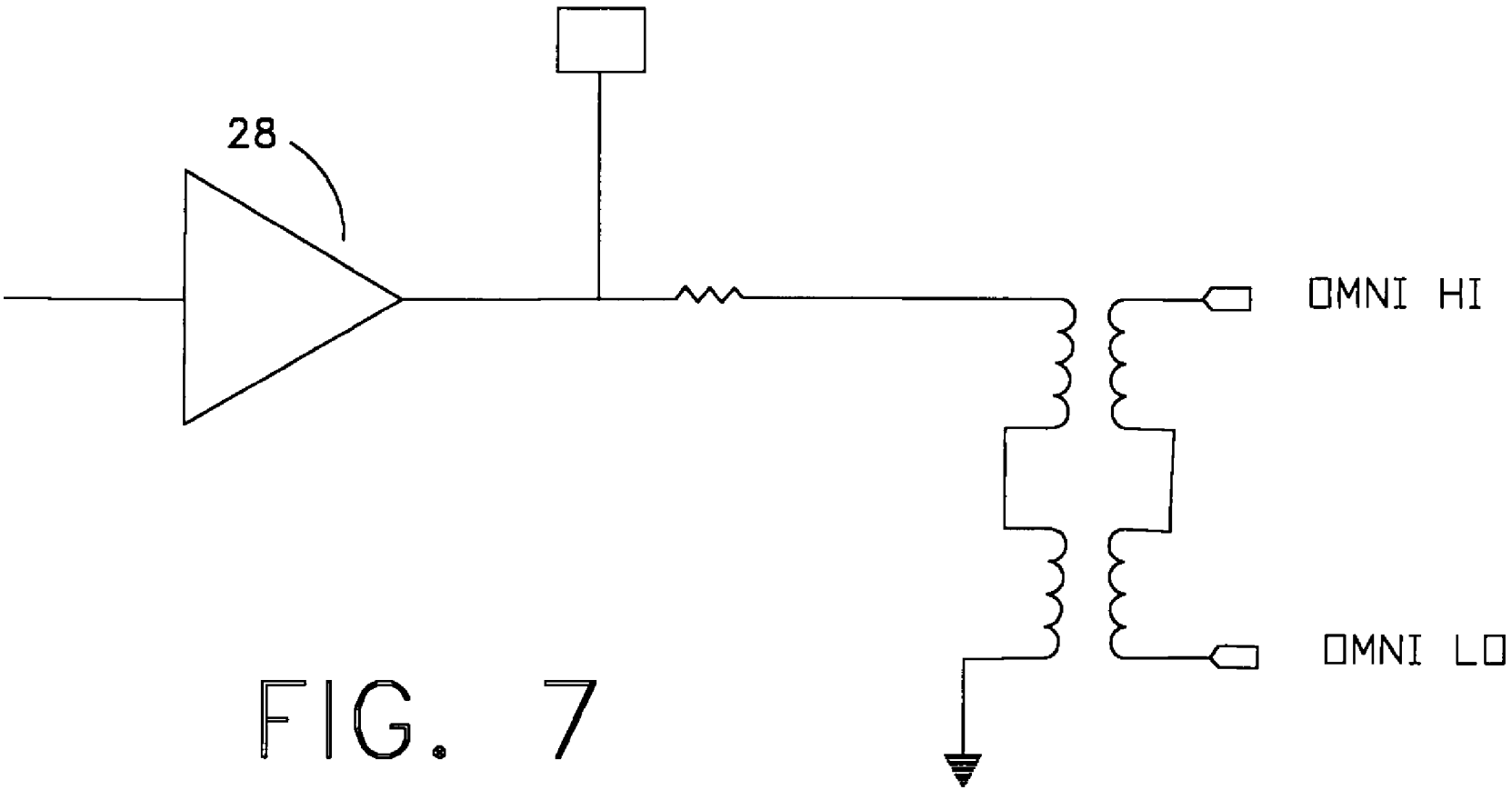
FIG. 7 is a circuit diagram of the drive stage of the omni-azimuthal pattern generator.

Referring to FIG. 7 there is illustrated the circuit diagram for the drive stage 18. The driver 28 and associated components provide a balanced 50-Ohm output in the form of an OMNI HI and OMNI LO signal.

The advantages of the present invention over the prior art are that the current invention is more lightweight. It is more compact than prior art devices. It does not require elaborate external drive circuitry. It uses no moving parts and requires no user intervention to operate.

What is claimed is:

1. An omni-azimuthal pattern generator for an antenna system having two identical orthogonal antennas each of which has a dipole moment and a plurality of transmission lines comprising:

a differential driver stage that isolates and unbalances a plurality of input signals from the two orthogonal antennas received through said plurality of transmission lines;

an all-pass network stage joined to said differential driver stage that introduces a relative phase shift of ninety degrees in said plurality of unbalanced signals from said differential driver stage;

a combiner stage joined to said all-pass network stage that combines the phase shifted plurality of signals from said all-pass network stage; and a drive stage joined to said combiner stage that receives the combined phase shifted plurality of signals from the combiner stage and provides a balanced output signal that is a combination of said input signals but that does not have a null along an axis between the two dipole moments of the two orthogonal antennas.

2. An omni-azimuthal pattern generator in accordance with claim 1 wherein said differential driver stage comprises:

a plurality of input points that receive said plurality of transmission lines from the orthogonal antennas; and a plurality of operational amplifiers circuits in parallel that serve as isolation amplifiers and as input converters to convert the input signals into a unbalanced signals for subsequent conditioning.

3. An omni-azimuthal pattern generator in accordance with claim 1 wherein said all-pass network stage comprises a plurality of calibrated, unity gain, single pole response operational amplifier circuits.

4. An omni-azimuthal pattern generator in accordance with claim 3 wherein each of said plurality of calibrated, unity gain, single pole response operational amplifier circuits further comprises:

a first resistor and an identical second resistor to give the circuit a gain of one; and a third resistor having resistance $R_1$ in series with a potentiometer having resistance $R_2$ and a capacitor having capacitance $C_1$, to set the pole frequency of said circuit.

5. An omni-azimuthal pattern generator in accordance with claim 4 wherein the transfer function of each of said plurality of calibrated, unity gain, single pole response operational amplifier circuits is $$H(j\omega) = \frac{1 - j\omega R_{EI} C_1}{1 + j\omega R_{EI} C_1},\ R_{EI} = R_1 + R_2.$$

6. An omni-azimuthal pattern generator in accordance with claim 5 wherein said relative phase shift of ninety degrees in said plurality of signals from the two orthogonal antennas is determined from the equation Δϕ=2 [−arc tan (ω/p1)+arc tan(ω/p2)−arc tan(ω/p3)+arc tan(ω/p4)−arc tan (ω/p5)+arc tan(ω/p6)], wherein proper selection of the pole frequencies provides a value of Δϕ that is 90 degrees over a frequency band of interest.

7. An omni-azimuthal pattern generator in accordance with claim 6 wherein the potentiometers are utilized in the all-pass network to calibrate the all-pass network before it is used to ensure that the pole frequencies are correctly set so that proper operation of the circuit over a desired frequency band is maintained.

8. An omni-azimuthal pattern generator in accordance with claim 7 wherein a plurality of test points in the all-pass network serve as connection points to a dual channel digitizing oscilloscope in order to set the pole frequencies precisely by means of the potentiometers.

9. An omni-azimuthal pattern generator in accordance with claim 1 wherein said combiner stage comprises an operational amplifier circuit that combines the phase shifted plurality of signals from the all-pass network stage.

10. An omni-azimuthal pattern generator in accordance with claim 1 wherein said driver stage comprises an operational amplifier circuit that includes a plurality of transformers to provide a balanced output signal.

11. A method for generating an antenna pattern for an antenna system having two identical orthogonal antennas each of which has a dipole moment and a plurality of transmission lines comprising:

isolating and unbalancing a plurality of input signals from the two orthogonal antennas received through said plurality of transmission lines;

introducing a relative phase shift of ninety degrees in said plurality of unbalanced signals;

combining the phase shifted plurality of signals; and receiving the combined phase shifted plurality of signals and providing a balanced output signal that is a combination of said input signals but that does not have a null along an axis between the two dipole moments of the two orthogonal antennas.

12. The method of claim 11 wherein introducing a relative phase shift of ninety degrees in said plurality of unbalanced signals comprises solving the equation $\Delta\phi=2\ [-\text{arc tan}(\omega/p1)+\text{arc tan}(\omega/p2)-\text{arc tan}(\omega/p3)+\text{arc tan}(\omega/p4)-\text{arc tan}(\omega/p5)+\text{arc tan}(\omega/p6)]$, wherein proper selection of the pole frequencies provides a value of $\Delta\phi$ that is 90 degrees over a frequency band of interest.

* * * * *